US006829806B2

(12) United States Patent
Egigian

(10) Patent No.: US 6,829,806 B2
(45) Date of Patent: Dec. 14, 2004

(54) ANCHOR DEVICE FOR A BEACH TOWEL HAVING A TOWEL ATTACHMENT MECHANISM AND METHOD THEREFOR

(76) Inventor: Donald D. Egigian, 5218 Creedance Blvd., Glendale, AZ (US) 85310

( * ) Notice: Subject to any disclaimer, the term of this patent is extended or adjusted under 35 U.S.C. 154(b) by 0 days.

(21) Appl. No.: 10/266,038

(22) Filed: Oct. 7, 2002

(65) Prior Publication Data

US 2004/0064914 A1 Apr. 8, 2004

(51) Int. Cl.[7] ..... A47G 27/04

(52) U.S. Cl. ..... 16/8; 16/4; 248/545; 248/156; 248/4.99; 135/15 PE; 52/417; 24/460

(58) Field of Search ..... 428/83, 102, 33, 428/192; 52/417, 4; 135/15 PE; 16/8, 4, 6; 5/417, 420; 248/545, 156; 24/460

(56) References Cited

U.S. PATENT DOCUMENTS 4,272,575 A 6/1981 Egigian

FOREIGN PATENT DOCUMENTS

FR 2657660 * 1/1990
FR 2784562 * 10/1998

* cited by examiner

*Primary Examiner*—Suzanne Dino Barrett
*Assistant Examiner*—Mark Williams
(74) *Attorney, Agent, or Firm*—Jeffrey D. Moy; Harry M. Weiss; Weiss, Moy & Harris, P.C.

(57) ABSTRACT

A device for securing a towel to the ground so the towel will not be blown away by the wind is comprises a first anchor devices coupled to a first end of the towel and a second anchor device coupled to a second end of the towel. The first anchor device and the second anchor device are coupled to the ground to prevent the towel from being blown away by the wind. The first anchor device and the second anchor device each comprises a body section. A first arc member is coupled to the body section. The first arc member is rolled in the ground so that ground elements rest inside the first arch member such that the weight of the ground elements prevents the beach towel from being blow away. A second arc member is coupled to the body section for securing the towel to the body section.

4 Claims, 1 Drawing Sheet

ANCHOR DEVICE FOR A BEACH TOWEL HAVING A TOWEL ATTACHMENT MECHANISM AND METHOD THEREFOR

BACKGROUND OF THE INVENTION

1. Field of the Invention

This invention relates generally to beach towels and, more specifically, to beach accessory which has a towel or mat for use upon a beach, the accessory including an anchor at each opposite end thereof, so as to prevent a strong wind from blowing the towel away, while persons are not lying down thereupon, and an attachment device for coupling the towel to the accessory.

2. Description of the Prior Art

It is generally well known, that when a conventional beach mat or large beach towel (hereinafter towel) is spread out upon the sand, there is a tendency for the towel to be blown away by the strong sea-shore winds. Because of this, when a person is not sitting or laying on the towel, it is common practice to place heavy objects, such as a lunch basket, bundles of clothing, and the like at the ends of the towel, so as to hold the towel down in the wind. Even while persons rest upon the towel, a wind may lift a free end of the towel, and blow it on a person, together with any sand that is on it.

Therefore, a need existed to provide an improved beach towel anchor. The improved beach towel anchor will be coupled at opposite ends of the beach towel for quickly and easily anchoring the beach towel in the sand so that a wind cannot lift it and blow it away. The improved beach towel anchor will have a mechanism for securely holding the beach towel anchor to the beach towel.

SUMMARY OF THE INVENTION

In accordance with one embodiment of the present invention, it is an object of the present invention to provide an improved beach towel anchor.

It is another object of the present invention to provide an improved beach towel anchor that will be coupled at opposite ends of the beach towel for quickly and easily anchoring the beach towel in the sand so that a wind cannot lift it and blow it away.

It is still another object of the present invention to provide an improved beach towel anchor that will have a mechanism for securely holding the beach towel anchor to the beach towel.

BRIEF DESCRIPTION OF THE EMBODIMENTS

In accordance with one embodiment of the present invention, a device for securing a towel to the ground so the towel will not be blown away by the wind is disclosed. The device comprises a first anchor devices coupled to a first end of the towel and a second anchor device coupled to a second end of the towel. The first anchor device and the second anchor device are coupled to the ground to prevent the towel from being blown away by the wind. The first anchor device and the second anchor device each comprises a body section. A first arc member is coupled to the body section. The first arc member is rolled in the ground so that ground elements rest inside the first arch member such that the weight of the ground elements prevents the beach towel from being blow away. A second arc member is coupled to the body section for securing the towel to the body section.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1A:
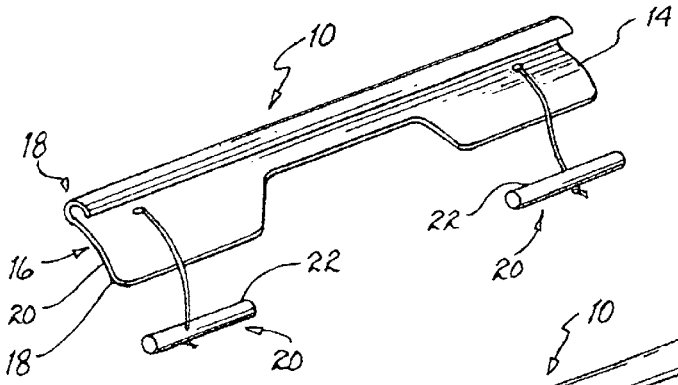
FIG. 1A is an elevated perspective view of the present invention.
Figure 1B:
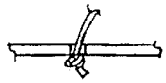
FIG. 1B is a close-up view of the towel locking device used in the present invention.
Figure 2:
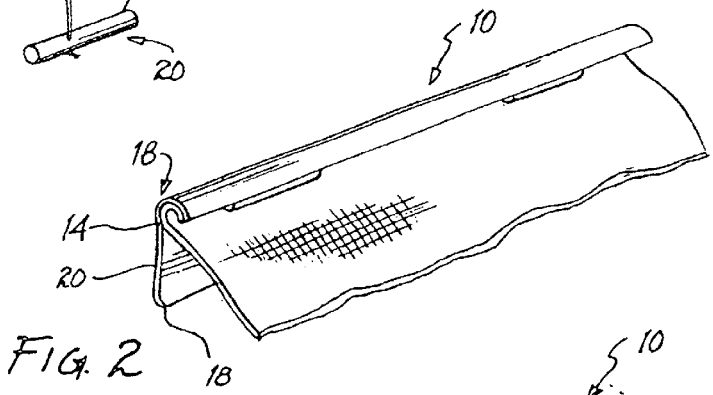
FIG. 2 is a partial cut-away view of the present invention installed on one end of a towel.
Figure 4:
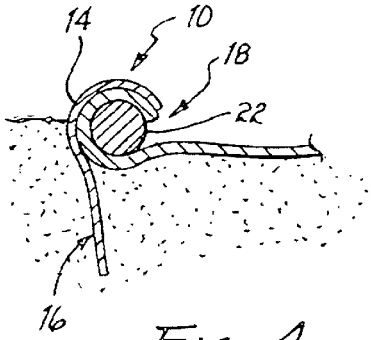
FIG. 4 is a cross-section view taken along lines 4—4 of FIG. 3.
Figure 3:
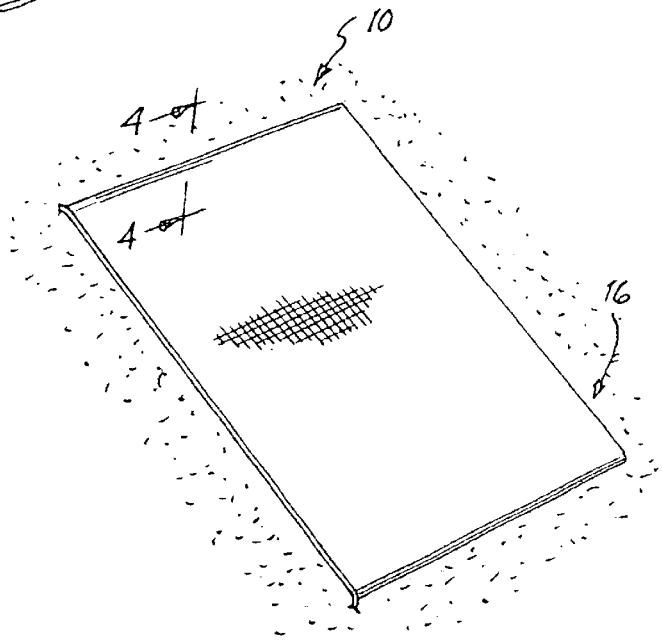
FIG. 3 is an elevated perspective view of the invention installed on both ends of a towel.

Referring to the Figures, wherein like numerals and symbols represent like elements, a beach towel/mat anchoring device 10 is shown. The device 10 is designed so that each end of a beach towel or mat (hereinafter beach towel) is removably coupled to a device 10. The device 10 will anchor the beach towel in the sand so that the wind cannot lift and blow away the beach towel.

The device 10 is comprised of a main body member 14. The main body member 14 is shaped like an "S". The bottom arch section 16 of the body member 14 is used to anchor the device 10 into the sand. In use, the bottom arch section 16 is used as a scoop. A bottom edge 18 of the bottom arch section 16 serves as a scoop lip for digging down into the sand. The bottom arch section 16 is then rolled in order that the sand rests inside a channel 20 formed by the bottom arch section 16. The weight of the sand holds the device 10 in place so that the beach towel doesn't blow away. When devices 10 are attached to opposite ends of the beach towel, the beach towel cannot be blown away by the wind.

The device 10 further has a top arch section 18. The top arch section 18 is used to hold the towel within the device 10. The towel is inserted into the top arch section 18. In order to more securely hold the towel within the top arch section 18, a locking device 20 is used. In accordance with one embodiment of the present invention, the locking device 20 is a rod member 22. The rod member 22 is inserted into the top arch section 18 so that the towel cannot be removed from the top arch section 18 without first removing the rod member 22. As may be seen more clearly in the Figures, one or more rod members 22 may be used. The rod members 22 may be coupled to the main body member 14 so that the rod members 22 will not be misplaced and are readily available for use.

The main body member 14 is generally formed from a rigid sheet of plastic material. However, this should not be seen as to limit the scope of the present invention. Other types of materials may be used without departing from the spirit and scope of the present invention. The main body member can also come in a variety of different sizes. A suggested size thereof is to be approximately thirty-six inches long. This size should be sufficient to hold a standard size beach towel. However, this is given only as an example and should not be seen as to limit the scope of the present invention. A diameter across the bottom arc section 16 is approximately two and one-half to three inches. This distance should provide a sufficient depth to hold the device 10 in the sand.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In combination, a towel securing device securing a towel to ground so the towel will not be blown away comprising:

a first anchor device coupled to a first end of the towel; and a second anchor device coupled to a second end of the towel;

wherein the first anchor device and the second anchor device are coupled to the ground to prevent the towel from being blown away;

wherein the first anchor device and the second anchor device each comprises:

a body section;

a first arc member coupled to the body section wherein the first arc member is rolled in the ground so that ground elements rest inside the first arch member such that the weight of the ground elements prevents the beach towel from being blow away;

a second arc member coupled to the body section for securing the towel to the body section; and a locking device to secure the towel to the second arc member, wherein the locking device is a rod member which is inserted in the second arc member to secure the towel.

2. A device for securing a towel to ground so the towel will not be blown away in accordance with claim 1 wherein the rod member is coupled to the body section so that the rod member will not be lost.

3. A device for securing a towel to ground so the towel will not be blown away in accordance with claim 1 wherein the locking device is a pair of rod members which are inserted in the second arc member to secure the towel.

4. A device for securing a towel to ground so the towel will not be blown away in accordance with claim 3 wherein the pair of rod members are coupled to the body section so that the rod members will not be lost.

* * * * *